US008061434B2

(12) United States Patent
Keskiniva et al.

(10) Patent No.: US 8,061,434 B2
(45) Date of Patent: Nov. 22, 2011

(54) PERCUSSION DEVICE

(75) Inventors: Markku Keskiniva, Ylöjärvi (FI); Jorma Mäki, Mutala (FI); Mauri Esko, Ikaalinen (FI); Erkki Ahola, Kangasala (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 11/886,679

(22) PCT Filed: Mar. 22, 2006

(86) PCT No.: PCT/FI2006/050109

§ 371 (c)(1),
(2), (4) Date: Sep. 19, 2007

(87) PCT Pub. No.: WO2006/100350

PCT Pub. Date: Sep. 28, 2006

(65) Prior Publication Data

US 2009/0025948 A1 Jan. 29, 2009

(30) Foreign Application Priority Data

Mar. 24, 2005 (FI) ..... 20055133

(51) Int. Cl.
*E21B 7/00* (2006.01)

(52) U.S. Cl. ..... 173/1; 173/4; 173/114

(58) Field of Classification Search ..... 173/1, 4, 173/11, 13, 114, 200, 206; 175/25
See application file for complete search history.

(56) References Cited

U.S. PATENT DOCUMENTS

| | | | | |
|---|---|---|---|---|
| 3,662,843 | A * | 5/1972 | Wise | 173/131 |
| 4,204,715 | A * | 5/1980 | Lavon | 299/16 |
| 4,289,275 | A * | 9/1981 | Lavon | 239/101 |
| 4,434,859 | A | 3/1984 | Rumpp et al. | |
| 4,930,584 | A * | 6/1990 | Chaur Ching et al. | 173/200 |
| 6,029,753 | A * | 2/2000 | Kuusento et al. | 173/1 |
| 6,186,246 | B1 * | 2/2001 | Muuttonen et al. | 173/1 |
| 6,209,661 | B1 * | 4/2001 | Muona | 175/25 |
| 6,375,271 | B1 * | 4/2002 | Young, III | 299/16 |
| 7,032,684 | B2 * | 4/2006 | Muuttonen et al. | 173/4 |
| 7,231,989 | B2 * | 6/2007 | Salminen et al. | 173/1 |
| 2004/0251049 | A1 * | 12/2004 | Keskiniva | 175/50 |

FOREIGN PATENT DOCUMENTS

| | | |
|---|---|---|
| JP | 2-298477 | 12/1990 |
| WO | 2005/002801 A1 | 1/2005 |

OTHER PUBLICATIONS

PCT Written Opinion and International Search Report mailed Jun. 28, 2006 issued in PCT/FI2006/050109.

* cited by examiner

*Primary Examiner* — Paul Durand
*Assistant Examiner* — Nathaniel Chukwurah
(74) *Attorney, Agent, or Firm* — Drinker Biddle & Reath LLP

(57) ABSTRACT

A method for controlling the operation of a pressure fluid operated percussion device and to a pressure fluid operated percussion device. The method includes influencing the shape of a stress wave by setting a suitable clearance between a transmission piston and a tool. The percussion device is provided with a device for setting the clearance between the transmission piston and the tool.

26 Claims, 3 Drawing Sheets

PERCUSSION DEVICE

CROSS REFERENCE TO RELATED APPLICATIONS

This application is the National Stage of International Application No. PCT/FI2006/050109 filed Mar. 22, 2006, and claims benefit of Finnish Application No. 20055133 filed Mar. 24, 2005.

FIELD OF THE INVENTION

The invention relates to a method for controlling the operation of a pressure fluid operated percussion device comprising: means for feeding pressure fluid into and discharging it from the percussion device; means for producing a stress wave by means of the pressure fluid pressure to a tool connectable to the percussion device to move in a longitudinal direction in relation to the body thereof, the means for producing the stress wave comprising a working chamber in the body of the percussion device and a transmission piston provided in the working chamber to move a longitudinal direction of the tool in relation to the body of the percussion device, the transmission piston having an energy transfer surface facing the tool to allow it to be brought into contact with an energy receiving surface of the tool or a shank connected to the tool; means for making the pressure fluid pressure prevailing in the working chamber push the transmission piston towards the tool for compressing the tool in the longitudinal direction thereof by means of the pressure fluid pressure acting on the transmission piston so that a stress wave is produced in the tool; and correspondingly means for making the transmission piston return. Further, the invention relates to a pressure fluid operated percussion device comprising: means for feeding pressure fluid into and discharging it from the percussion device; means for producing a stress wave by means of the pressure fluid pressure to a tool connectable to the percussion device to move in a longitudinal direction in relation to the body thereof, the means for producing the stress wave comprising a working chamber in the body of the percussion device and a transmission piston provided in the working chamber to move a longitudinal direction of the tool in relation to the body of the percussion device, the transmission piston having an energy transfer surface facing the tool to allow it to be brought into contact with an energy receiving surface of the tool or a shank connected to the tool; means for making the pressure fluid pressure prevailing in the working chamber push the transmission piston towards the tool for compressing the tool in the longitudinal direction thereof by means of the pressure fluid pressure acting on the transmission piston so that a stress wave is produced in the tool; and correspondingly means for making the transmission piston return.

BACKGROUND OF THE INVENTION

In prior art percussion devices strokes are generated by means of a reciprocating percussion piston, which is typically driven hydraulically or pneumatically and in some cases electrically or by means of a combustion engine. A stress wave is created in a tool, such as a drill rod, when the percussion piston strikes an impact end of either a shank or the tool.

A problem with prior art percussion devices is that the reciprocating motion of the percussion piston generates dynamic acceleration forces that make the equipment difficult to control. At the same time as the percussion piston accelerates in the striking direction, the body of the percussion device tends to move in the opposite direction, thereby decreasing the pressing force of the drill bit or the tool tip on the material to be treated. To maintain the pressing force of the drill bit or the tool against the material to be treated sufficiently high, the percussion device must be pushed towards the material with a sufficient force. This additional force must then be taken into account in the support structures of the percussion device, as well as elsewhere, which increases not only the size and mass of the equipment but also the manufacturing costs thereof. The mass of the percussion piston causes inertia that restricts the frequency of the reciprocating motion of the percussion piston and thereby its impact frequency, although the latter should be significantly raised from its current level in order to achieve a more efficient performance. However, with current solutions this leads to a considerable deterioration in operating efficiency, which is why it is not possible in practice. Further, in prior art percussion devices it is quite difficult to control the percussion power according to drilling conditions. Further still, prior art knows percussion devices in which the stress wave is generated by rapidly compressing the tool against the material to be broken, without delivering a stroke.

BRIEF DESCRIPTION OF THE INVENTION

It is an object of the invention to provide a method for controlling a percussion device and a percussion device, preferably for a rock drilling apparatus or the like, which has fewer drawbacks than prior art solutions as regards dynamic forces caused by the impact operations and which allows strike frequency to be increased more easily than currently possible. A further object of the invention is to provide a method for controlling a percussion device and a percussion device allowing the shape, length and/or other characteristics of a stress wave transmitted to a tool to be adjusted in a simple manner.

The method of the invention is characterized by comprising: influencing the shape of the stress wave by setting a clearance between the energy transfer surface of the transmission piston and said energy receiving surface before pressure fluid is allowed to push the transmission piston towards the tool so that when the clearance is at its smallest, the energy transfer surface of the transmission piston is in contact with the energy receiving surface of the tool or of a shank connected to the tool at the moment when the effect of the pressure fluid pressure begins, the stress wave being thus produced substantially by the effect of the pressing force produced by the pressure fluid pressure alone and transmitted to the tool by the transmission piston, its length being substantially equal to the effective time of the pressing force acting on the tool, whereas when the clearance is at its longest, the stress wave is substantially produced by the impact of the transmission piston created as a result of a transmission piston motion caused by the pressure fluid pressure and acting on the energy receiving surface of the tool or a shank connected to the tool, the length of the stress wave being substantially twice the length of the transmission piston.

The percussion device of the invention is characterized in that it comprises means for influencing the shape of the stress wave by setting a clearance between the energy transfer surface of the transmission piston and said energy receiving surface before pressure fluid is allowed to push the transmission piston towards the tool so that when the clearance is at its smallest, the energy transfer surface of the transmission piston is in contact with the energy receiving surface of the tool or of a shank connected to the tool at the moment when the effect of the pressure fluid pressure begins, the stress wave being thus produced substantially by the effect of the pressing force produced by the pressure fluid pressure alone and transmitted to the tool by the transmission piston, its length being substantially equal to the effective time of the pressing force acting on the tool, whereas when the clearance is at its longest, the stress wave is substantially produced by the effect of the transmission piston created as a result of a transmission piston motion caused by the pressure fluid pressure and acting on the energy receiving surface of the tool or a shank connected to the tool, the length of the stress wave being substantially twice the length of the transmission piston.

A basic idea of the invention is that the clearance between the transmission piston and the tool, between the transmission piston and a transmission piece provided between the transmission piston and the tool, or between the transmission piece and the tool is provided with a desired size to produce a desired stress wave on the tool.

An advantage of the invention is that a pulse-like stroke thus generated does not require a percussion piston moving on a long reciprocating travel and thus there are no great masses to be moved back and forth in the stroke direction, as a result of which the dynamic forces crated are small compared with those of the prior art heavy reciprocating percussion pistons. Further, this configuration allows stroke frequency to be increased without substantially impairing effectiveness. A further advantage of the invention is that by adjusting the clearance between the percussion element and the tool, the shape and/or other characteristics of the stress wave transmitted to the tool are easily adjustable as required by working conditions, such as the hardness of the material to be drilled or struck.

BRIEF DESCRIPTION OF THE FIGURES

The invention will be described in greater detail with reference to the following drawings, in which.

DETAILED DESCRIPTION OF THE INVENTION

Figure 1:
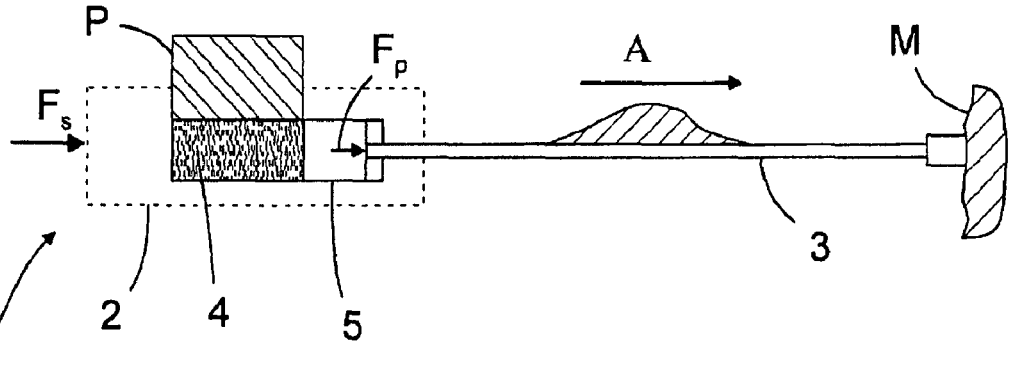
FIG. 1 is a schematic view of an operating principle of a percussion device of the invention.

In FIGS. 1 to 7 like components are given like reference numerals, and their functioning and characteristics are not going to be repeated in connection with each figure more than is necessary for understanding the disclosure.

FIG. 1 is a schematic view of an operating principle of a percussion device of the invention. The Figure shows a percussion device 1 and its body 2 drawn with a broken line, one end of the body being provided with a tool 3 that is longitudinally movable in relation to the percussion device 1. Inside the body 2 there is a working chamber 4 into which pressure fluid is supplied in different ways, to be described below, to generate a stress wave. The working chamber 4 is partly defined by a transmission piston 5 located between the chamber and the tool 3 and movable in the axial direction of the tool 3 in relation to the body 3. The percussion device is pushed into the direction of the material to be broken as indicated by arrow $F_S$ to enable the tip of the tool 3, i.e. most commonly a drill bit, to be pressed with sufficient force against the material M to be broken. Since the transmission piston 5 is subject to a pressurized pressure fluid pushing the transmission piston 5 towards the tool 3, the pressing force $F_p$ generated by pressure P is transmitted via the transmission piston 5 to compress the tool 3 and thereby cause a stress wave in the tool 3, the wave propagating in the direction of arrow A through the tool 3 into the material M to be broken.

Figure 2:
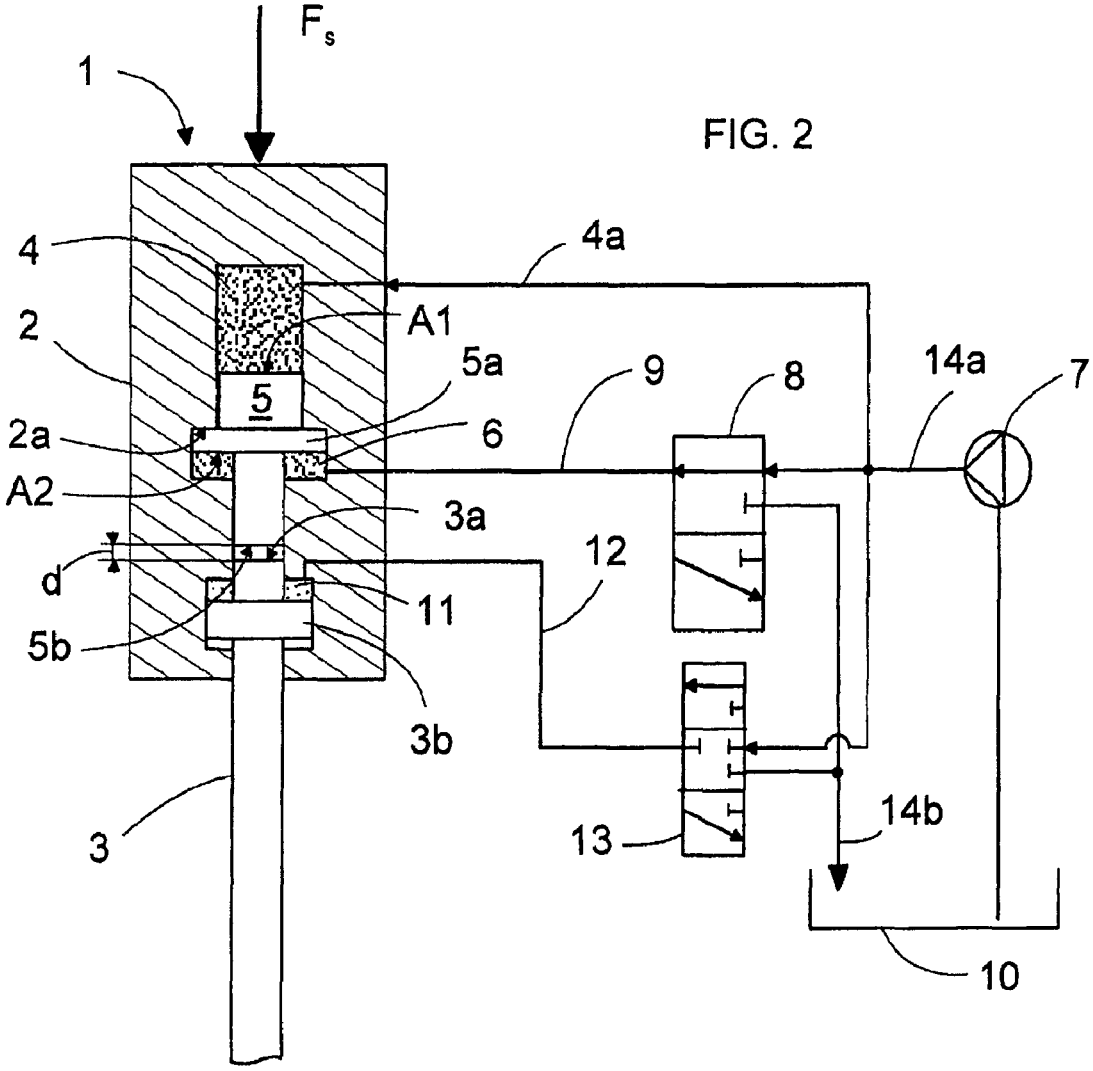
FIG. 2 is a schematic view of an embodiment of the percussion device of the invention.

FIG. 2 is a schematic view of an embodiment of a percussion device of the invention. The working chamber 4 is connected via a channel 4*a* to a pressure source, such as a pressure fluid pump 7, feeding pressurized pressure fluid into the chamber 4. On the other side of the transmission piston 5, opposite the working chamber 4, there is a return chamber 6, which is in turn connected via a channel 9 and a valve 8 to the pressure fluid source, such as the pressure fluid pump 7, feeding pressurized pressure fluid to the valve 8 through a channel 14*a*. From the valve 8 there is a pressure fluid return conduit 14*b* to a pressure fluid container 10.

In the situation shown in FIG. 2, a return operation of the transmission piston 5 is carried out, which means that pressure fluid is supplied into the return chamber 6 under the control of the valve 8 so that the transmission piston 5 moves towards the working chamber 4 until it has settled into its uppermost or rear position shown in FIG. 2. At the same time, pressure fluid is discharged from the working chamber 4. The rear position of the transmission piston 5 in the percussion device 1 is using mechanical solutions, such as different collars or stoppers, implemented in the embodiment of FIG. 2 by a collar 2*a* and the rear surface of a flange 5*a*. During operation, the percussion device 1 is pushed towards the material to be treated by a force $F_S$, known as the feed force, which keeps the tip of the tool 3, i.e. the drill bit or the like, in contact with the material to be treated. When the transmission piston 5 has moved into the position shown in FIG. 2, the valve 8 is moved into another position, thus allowing pressure fluid to be abruptly discharged from the return chamber 6 into the pressure fluid container 10. This allows the transmission piston 5 to be pushed forward into the direction of the tool 3 by the effect of both the pressure fluid already in the working chamber 4 and the fluid flowing there from the pressure fluid pump 7. The pressure acting on the transmission piston 5 in the working chamber 4 generates a pressing force that pushes the transmission piston 5 towards the tool 3. This pressing force in turn compresses the tool 3, when the energy transfer surface 5*b* of the transmission piston 5 and the energy receiving surface 3*a* of the tool or a shank connected thereto are in contact with each other. As a result, a sudden compression stress is generated in the tool 3 via the transmission piston 5, this then producing a stress wave extending through the tool 3 to the material to be treated. From the material to be treated, a pulse known as a reflected pulse returns through the tool 3, thereby pushing the transmission piston 5 back towards the working chamber, the energy of the reflected pulse thus being transmitted into the pressure fluid in the working chamber 4. At the same time the valve 8 is switched back to the position shown in FIG. 2 and pressure fluid is again supplied into the return chamber 6 so as to push the transmission piston 5 into its predetermined rear position.

There are various alternatives for selecting the pressure surfaces of the transmission piston 5, i.e. a surface A1 facing the working chamber 4 and a surface A2 facing the return chamber 6. The simplest alternative is the one shown in FIG. 2, where the surfaces differ in size. In this case suitably selected surface areas will allow an equal pressure to be applied on both sides of the transmission piston 5. Therefore pressure fluid may be supplied to the chambers from the same source. This facilitates the implementation of the percussion device and provides a further advantage in that the transmission piston 5 can be easily provided with a collar-like flange 5*a* formed thereto and the body with a corresponding collar 2*a*, the collar 2*a* of the body 2 determining the rear position of the transmission piston 5, i.e. the uppermost position in the Figure, and the position where the generating of the stress wave always begins. It is also possible to have surface areas of an equal size, in which case the pressure must be higher in the return chamber 6 than in the working chamber 4.

FIG. 2 further shows, by way of example, an auxiliary piston 3*b* formed to the tool 3 or to the shank connected thereto and located in a cylinder space 11 provided in the body of the percussion device. The cylinder space 11, in turn, is connected to the pressure fluid pump 7 via a channel 12 and a valve 13 to allow pressure fluid to be fed into the cylinder space 11 for the purpose of adjusting the size of a clearance d marked in the Figure so as to obtain a desired energy transfer and a stress wave shape. By feeding into the cylinder space 11 an amount of pressure fluid equal to a specific volume, a clearance d is formed between the transmission piston 5 on one side and the tool 3 or an impact surface of a shank connected thereto on the other side. The clearance d may obtain a value varying between zero and a desired value of 2 mm at its maximum, for example. A suitably adjusted clearance allows the energy transmitted to the tool to be divided into impact energy, on one hand, and to transfer energy on the other. Impact energy can be defined by the following formula:

$$E_{impact}=\tfrac{1}{2}mv_{t0}^2 \quad (1)$$

where $E_{impact}$=impact energy m=transmission piston mass $v_{t0}$=transmission piston velocity at the moment it strikes the tool Correspondingly, transfer energy can be defined by the following formula:

$$E_s=\int_{s_0}^{s_1} F_p\,ds=\int_{t_0}^{t_1} F_p\,v\,dt,$$

where $E_s$=transfer energy $s_0$=the position of the tool tip at time instant $t_0$, when the transmission piston comes into contact with the tool and compression starts $s_1$=the position of the tool tip at time instant $t_1$, when compression ends $F_p$=pressing force generated by pressure and acting on the tool Impact energy $E_{impact}$ is transferred when the energy transfer surface 5*b* of the transmission piston 5 strikes the energy receiving surface 3*a* of the tool or the shank shortly after the pressure starts to push the transmission piston 5 towards the tool 3. The greater the clearance, the greater the amount of energy transferred in the form of impact energy and, correspondingly, the lesser the amount transferred as transfer energy from the moment when the transmission piston 5 rests against the tool tip either directly or through a separate transmission piece. This adjustment is particularly applicable for striking or drilling different types of rock material so that a greater clearance is used for harder rock material and a greater amount of energy is transferred as impact energy, whereas a smaller clearance is be used for softer rock material and a greater amount of energy is transferred as transfer energy.

Figure 3:
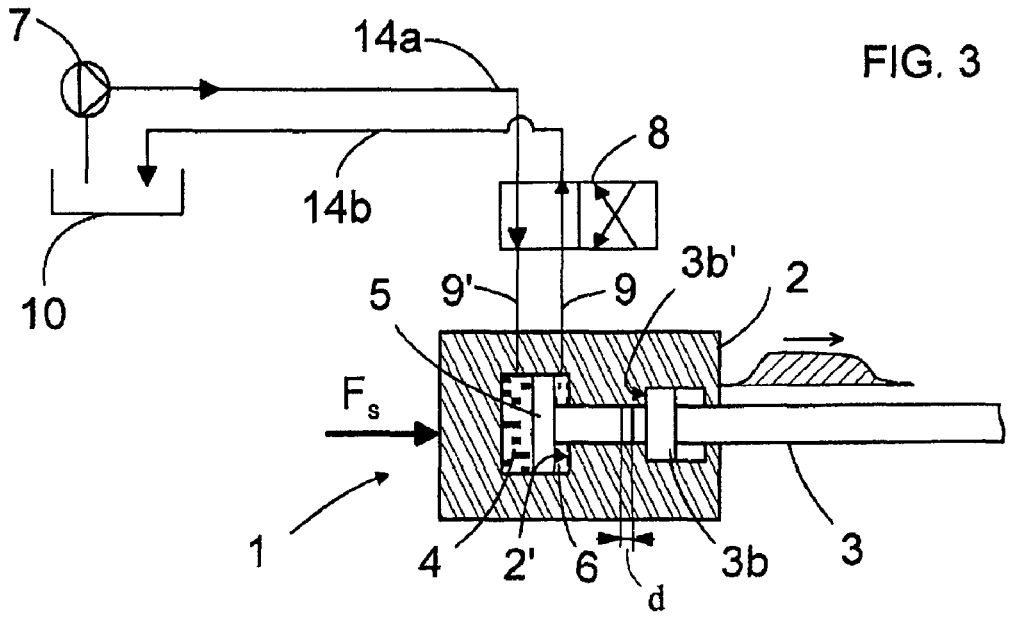
FIG. 3 is a schematic view of a second embodiment of the percussion device of the invention.

FIG. 3 is a schematic view of a second percussion device suitable for implementing the method of the invention. This embodiment differs from the one above in that pressure fluid is not fed continuously into the working chamber 4, but the pressure fluid pressure is made to act directly on the transmission piston 5 alternately via the working chamber 4 and the return chamber 6. When in operation, the percussion device is pushed forward at a force $F_S$ so that a collar 3*b*' of the tool 3 rests against the body 2 at the same time as the tool 3 is in contact with the material that is the object of the impact, such as rock (not shown) that is to be broken. In the situation illustrated in FIG. 3 the control valve 8 is used to allow pressure fluid to flow rapidly through the conduit 9' into the working chamber 4, where it acts on the pressure surface of the transmission piston 5 facing away from the tool. At the same time the pressure fluid is allowed to exit from the return chamber 6 through the channel 9. The sudden surge of pressurized pressure fluid into the working chamber 4 generates a pressure pulse, the force it produces pushing the transmission piston 5 towards the tool 3 and thereby compressing the tool in the longitudinal direction thereof. This produces a stress wave in the drill rod or other tool in the form of a wave that propagates to the tool tip, such as a drill bit, causing there an impact on the material to be treated by means of percussion devices known per se. When a stress wave of a desired length has been produced, the supply of pressure fluid into the working chamber 4 is cut off by means of the control valve 8, thus terminating the generation of the stress wave, and pressure fluid is allowed to flow from the working chamber 4 through a return channel 9' and the control valve 8 into the pressure fluid container 10. At the same time pressure fluid is supplied into the return chamber 6 via the channel 9 to allow the transmission piston 5 to return backward. This takes place by moving the control valve 8 to the left from the position shown in FIG. 3 to cross-connect the pressure fluid feed and supply channels. Pressure fluid is fed into the return chamber 6 in an amount that will move the transmission piston 5 towards the working chamber 4 for a desired distance. In other words, this allows the length of the clearance d between the tool and the transmission piston to be adjusted, because the return motion of the tool stops, when its collar 3*b*' comes into contact with the body 2, but the transmission piston is still able to move further backward. Correspondingly, by adjusting the length and the pressure of the pressure pulse of the pressure fluid, it is possible to adjust the length and intensity of the stress wave. Yet another way to adjust the characteristics of the percussion device is to adjust the time between the pulses and/or the feed frequency of the pulses and the clearance. If a situation in which the clearance d=0 is to be aimed at, the return motion of the transmission piston can be implemented simply by pushing the percussion device 1 into the direction of the tool 3 at a feed force $F_S$. The tool 3 then pushes the transmission piston 5 backward for a suitable distance.

The effect of the force generated by pressure and acting on the tool 3 through the transmission piston 5 can be terminated also in other ways than by cutting the supply of pressure fluid into the working chamber 4. For example, the movement of the transmission piston 5 can stopped against the collar 2', whereby the pressure acting in the working chamber 4 behind the transmission piston 5 is no longer able to push the piston into the direction of the tool 3 in relation to the body 2.

Figure 4:
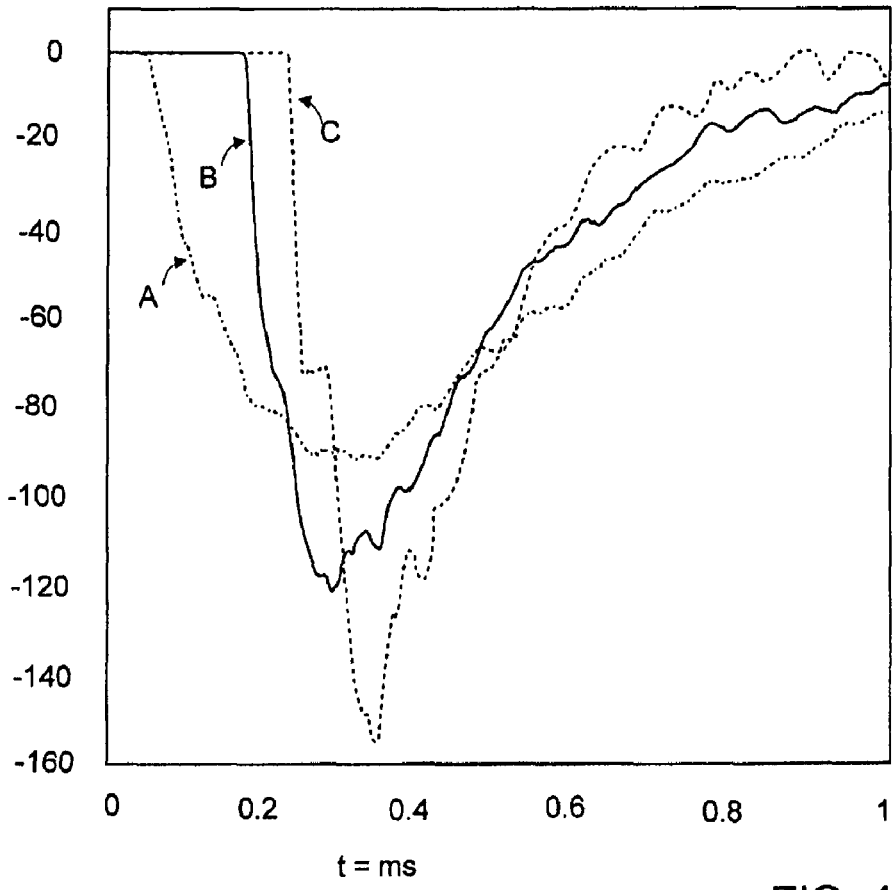
FIG. 4 is a schematic graph depicting the operation of the percussion device of the invention with different values of clearance.

FIG. 4 is a schematic graph of the operation of an embodiment of the invention and its energy transfer in a situation, where the clearance between the transmission piston 5 and the tool or between the transmission piston 5 and the transmission piece between the transmission piston 5 and the tool 3 is varied. Curve A depicts energy transfer in a situation in which the clearance d is 0 mm. In this case the stress wave is transferred from the transmission piston 5 to the tool entirely in the form of transfer energy. In the situation depicted by curve B the clearance d is 0.2 mm. In this case the transmission piston 5 may first move in the tool direction for 0.2 mm without resistance. After less than 0.2 ms, a stress wave is therefore first produced in the tool by the impact of the transmission piston 5 or the transmission piece between the piston and the tool striking the tool. This transfers energy from the transmission piston 5 to the tool in the form of impact energy. From there on, until about 0.3 ms has elapsed, energy transfers in the form of transfer energy as the force produced by the pressure fluid pressure acts on the transmission piston 5 and compresses the tool. Curve C, in turn, depicts a situation in which the clearance d is 0.4 mm, whereby the transmission piston 5 moves towards the tool for 0.25 ms, most of the energy being transferred to the tool in the form of impact energy and the rest in the form of transfer energy, because the transmission piston 5 and the tool remain in contact with each other for about 0.1 ms.

Figure 5:
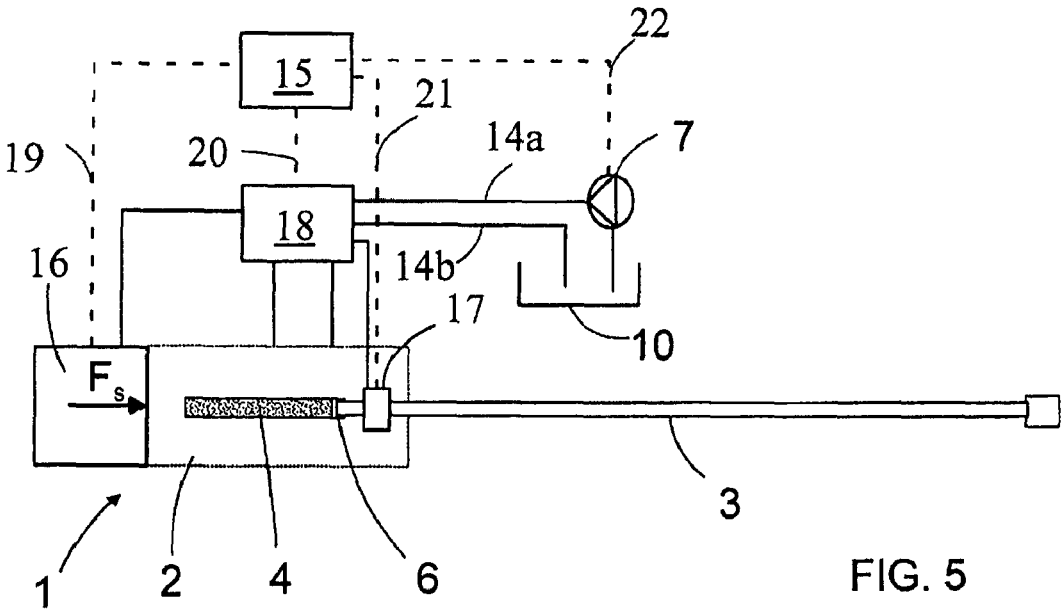
FIG. 5 is a schematic view of a third embodiment of the percussion device of the invention.

FIG. 5 is a schematic view of a third embodiment of a percussion device of the invention. This embodiment relates to a control method of the percussion device of the invention and a basic description of control equipment thereof.

The control equipment is provided with a control unit 15 controlling the functions of the percussion device. Further, reference number 16 denotes feed equipment, which may be any kind of feed equipment known per se for pushing the percussion device 1 forward in the direction of the tool 3. Reference numeral 17 denotes a unit for measuring and adjusting the clearance d during the operation of the percussion device. Further, reference numeral 18 denotes pressure fluid control valves that may either consist of separate valves or form a single valve configuration. The feed device 16, the clearance measurement and adjustment unit 17, and the control valves 18 are connected to the control unit 15 by means of signal channels 19 to 21, depicted with broken lines, which are typically electric conduits. The pressure fluid pump 7 and the pressure fluid container 10 are connected to the control valves 18 by channels 14*a* and 14*b*, respectively, the control valves 18 being, in turn, provided with pressure fluid channels leading to the feed equipment 16, impact device 1, and clearance measurement and adjustment unit 17. Further, the control unit 15 may be connected to control the pump 7, as shown with a broken line 22.

When the percussion device is in operation, sensors provided in the measurement and adjustment unit 17 measure the operation of the percussion device 1 for example by measuring the clearance d and/or the return pulse of the stress wave coming from the tool 3. On the basis of these measurement values, the clearance d is then adjusted as desired according to the drilling conditions. Likewise, the control unit 15 can also be used to control feed and pressure fluid pressure as well as the functions of the percussion device in general either by means of separate manual guides or automatically, on the basis of preset parameters.

Figure 6:
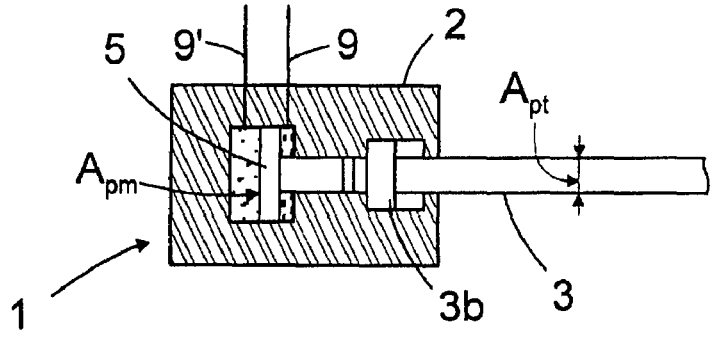
FIG. 6 is a schematic view of yet another embodiment of the percussion device of the invention.

FIG. 6 is yet another view of an embodiment of the percussion device of the invention. The essential elements of this embodiment are the cross-sectional surfaces of the transmission piston 5 and the tool. This embodiment corresponds to that of FIG. 3, for example, and therefore it is not considered necessary to repeat the disclosure of the details already described. The effective pressure surface of the transmission piston is its cross-sectional surface $A_{pm}$ facing the working chamber. The corresponding cross-sectional surface on the tool is $A_{pt}$. In order to make the compression stress as high as possible in relation to the pressure fluid pressures available, it would be advantageous to have in the transmission piston 5 a surface area $A_{pm}$ at least three times the size of the cross-sectional area $A_{pt}$ of the tool 3.

Figure 7:
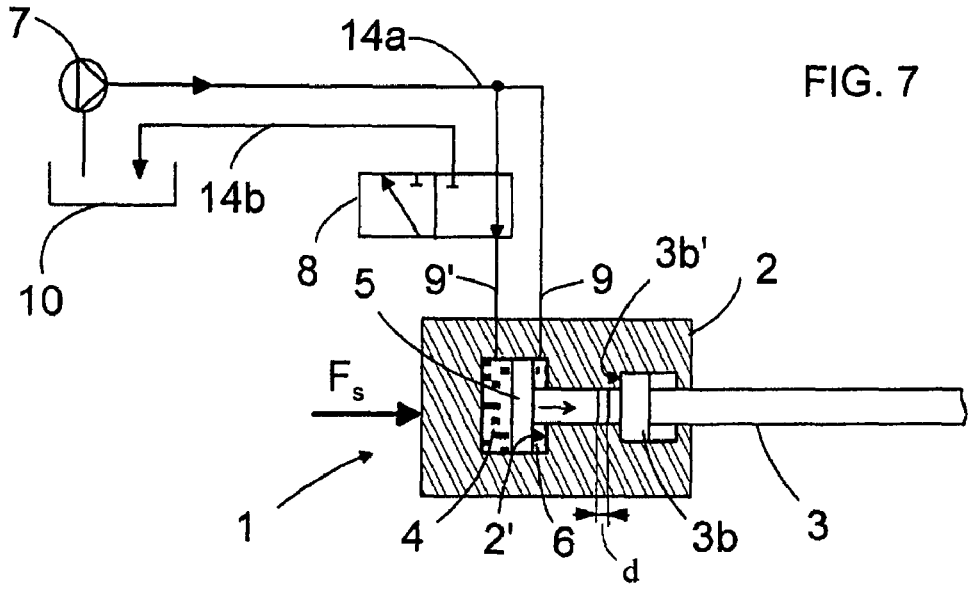
FIG. 7 is a schematic view of yet another embodiment of the percussion device of the invention.

FIG. 7 is yet another schematic view of a percussion device suitable for implementing the method of the invention. This embodiment corresponds otherwise to the solution of FIG. 3, except that here the pressure fluid pressure acts in the return chamber 6 all the time during the operation, pressure fluid being alternately fed into and discharged from the working chamber 4 through the control valve 8. In this case the force compressing the tool 3 is created as a result of the difference in the surface area between the pressure surfaces, because the surface facing the working chamber 4 is greater than the surface facing the return chamber 6. In the situation of FIG. 7 the transmission piston 5 is subject to a force caused by the pressure fluid pressure prevailing in the working chamber 4 and moving it towards the tool 3.

The above specification and the accompanying drawings are only meant to illustrate the invention and not to restrict it in any way. An essential aspect of the invention is that stress wave characteristics are adjusted by providing a clearance of a desired size between the transmission piston and the tool so that the tool may be subjected to a stress generated only by compression or to a stress generated only by the kinetic energy caused by an impact, or to a combined form of stress of some kind. The various details and solutions of the embodiments illustrated in the different Figures may be combined in various ways for different practical implementations.

The invention claimed is:

1. A method for controlling the operation of a pressure fluid operated percussion device comprising:

means for feeding pressure fluid into and discharging the fluid from the percussion device;

mean for producing a stress wave by means of the pressure fluid pressure to a tool connectable to the percussion device to move in a longitudinal direction in relation to the body thereof, the means for producing the stress wave comprising a working chamber in the body of the percussion device and a transmission piston provided in the working chamber to move a longitudinal direction of the tool in relation to the body of the percussion device, the transmission piston having an energy transfer surface facing the tool to allow it to be brought into contact with an energy receiving surface of the tool or a shank connected to the tool;

means for making the pressure fluid pressure prevailing in the working chamber push the transmission piston towards the tool for compressing the tool in the longitudinal direction thereof by means of the pressure fluid pressure acting on the transmission piston so that a stress wave is produced in the tool; and correspondingly means for making the transmission piston return, the method comprising:

influencing the shape of the stress wave by setting a clearance (d) between the energy transfer surface of the transmission piston and said energy receiving surface before pressure fluid is allowed to push the transmission piston towards the tool so that when the clearance (d) is at its smallest, the energy transfer surface of the transmission piston is in contact with the energy receiving surface of the tool or of a shank connected to the tool at the moment when the effect of the pressure fluid pressure begins, the stress wave being thus produced substantially by the effect of the pressing force produced by the pressure fluid pressure alone and transmitted to the tool by the transmission piston, the length of the stress wave being substantially equal to the effective time of the pressing force acting on the tool, whereas when the clearance (d) is at its longest, the stress wave is substantially produced by the impact of the transmission piston created as a result of a transmission piston motion caused by the pressure fluid pressure and acting on the energy receiving surface of the tool or a shank connected to the tool, the length of the stress wave being substantially twice the length of the transmission piston, and whereas when the clearance (d) is set to a value between the smallest and largest extent, the stress wave is produced by the combination of initial impact energy of the transmission piston acting on the energy receiving surface of the tool or a shank connected to the tool and transfer energy caused by the pressing force produced by the pressure fluid pressure alone transmitting to the tool by the transmission piston.

2. A method according to claim 1, including adjusting the clearance (d) according to drilling conditions.

3. A method according to claim 1, including reducing the clearance (d) in order to increase the amount of transfer energy ($E_S$) caused by the compression in the stress wave.

4. A method according to claim 1, including increasing the clearance (d) in order to increase the amount of impact energy ($E_{impact}$) caused by a transmission piston stroke in the stress wave.

5. A method according to claim 1, wherein the size of the clearance (d) is set according to the characteristics of the material to be drilled.

6. A method according to claim 1, wherein the size of the clearance (d) is set at a value between 0 and 2 mm.

7. A method according to claim 6, wherein the size of the clearance (d) is adjusted within a range from 0 to 2 mm.

8. A method according to claim 1, wherein the transmission piston is provided with a pressure surface area ($A_{pm}$) that is at least three times the cross-sectional surface area ($A_{pt}$) of the tool.

9. A pressure fluid operated percussion device comprising:

means for feeding pressure fluid into and discharging the fluid from the percussion device;

means for producing a stress wave by means of the pressure fluid pressure to a tool connectable to the percussion device to move in a longitudinal direction in relation to the body thereof, the means for producing the stress wave comprising a working chamber in the body of the percussion device and a transmission piston provided in the working chamber to move in a longitudinal direction of the tool in relation to the body of the percussion device, the transmission piston having an energy transfer surface facing the tool to allow it to be brought into contact with an energy receiving surface of the tool or a shank connected to the tool;

means for making the pressure fluid pressure prevailing in the working chamber push the transmission piston towards the tool for compressing the tool in the longitudinal direction thereof by means of the pressure fluid pressure acting on the transmission piston so that a stress wave is produced in the tool; and correspondingly means for making the transmission piston return; and means for influencing the shape of the stress wave by setting a clearance (d) between the energy transfer surface of the transmission piston and said energy receiving surface before pressure fluid is allowed to push the transmission piston towards the tool so that when the clearance (d) is at its smallest, the energy transfer surface of the transmission piston is in contact with the energy receiving surface of the tool or of a shank connected to the tool at the moment when the effect of the pressure fluid pressure begins, the stress wave being thus produced substantially by the effect of the pressing force produced by the pressure fluid pressure alone and transmitted to the tool by the transmission piston, the length of the stress wave being substantially equal to the effective time of the pressing force acting on the tool, whereas when the clearance (d) is at its longest, the stress wave is substantially produced by the impact of the transmission piston created as a result of a transmission piston motion caused by the pressure fluid pressure and acting on the energy receiving surface of the tool or a shank connected to the tool, the length of the stress wave being substantially twice the length of the transmission piston, and whereas when the clearance (d) is set to a value between the smallest and largest extent, the stress wave is produced by the combination of initial impact energy of the transmission piston acting on the energy receiving surface of the tool or a shank connected to the tool and transfer energy caused by the pressing force produced by the pressure fluid pressure alone transmitting to the tool by the transmission piston.

10. A percussion device according to claim 9, comprising means for receiving feed force and for supplying the feed force to the tool.

11. A percussion device according to claim 9, wherein the means for producing the stress wave comprise means for supplying pressure fluid alternately directly into the working chamber to act on the tool via the transmission piston and out of the chamber.

12. A percussion device according to claim 9, wherein the means for generating the stress wave comprises means for leading pressured pressure fluid continuously into the working chamber to act on the tool via the transmission piston and means for feeding pressure fluid alternately to act on the transmission piston via the return chamber opposite the working chamber so as to push the transmission piston towards the working chamber and, correspondingly, away from the return chamber to allow the pressure of the pressure fluid in the working chamber to push the transmission piston towards the tool.

13. A percussion device according to claim 9, wherein the means for adjusting the clearance (d) comprises means for moving the transmission piston to a predetermined position in relation to the body of the percussion device so as to provide a clearance of a desired size.

14. A percussion device according to claim 9, comprising a control unit, a unit for measuring and adjusting clearance (d) and at least one control valve for controlling pressure fluid supply to the percussion device, and in that when the percussion device is in operation, the control unit is connected to control the clearance measurement and adjustment unit on the basis of measured parameters.

15. A percussion device according to claim 9, wherein the percussion device belongs to a rock drilling apparatus.

16. A percussion device according to claim 9, comprising a control valve for controlling the flow of pressure fluid into and out of the percussion device.

17. A percussion device according to claim 15, comprising means for continuously supplying pressure fluid into the percussion device and that the control valve is configured to control the discharge of the pressure fluid periodically.

18. A percussion device according to claim 9, wherein the size of the clearance (d) is set at a value between 0 and 2 mm.

19. A percussion device according to claim 18, wherein the size of the clearance (d) is adjusted within a range from 0 to 2 mm.

20. A percussion device according to claim 9, wherein the pressure surface ($A_{pm}$) of the transmission piston is at least three times the cross-sectional surface ($A_{pt}$) of the tool.

21. A method for controlling the operation of a pressure fluid operated percussion device comprising:

means for feeding pressure fluid into and discharging the fluid from the percussion device;

means for producing a stress wave by means of the pressure fluid pressure to a tool connectable to the percussion device to move in a longitudinal direction in relation to the body thereof, the means for producing the stress wave comprising a working chamber in the body of the percussion device and a transmission piston provided in the working chamber to move a longitudinal direction of the tool in relation to the body of the percussion device, the transmission piston having an energy transfer surface facing the tool to allow it to be brought into contact with an energy receiving surface of an auxiliary piston formed to the tool or to a shank connected to the tool;

means for making the pressure fluid pressure prevailing in the working chamber push the transmission piston towards the tool for compressing the tool in the longitudinal direction thereof by means of the pressure fluid pressure acting on the transmission piston so that a stress wave is produced in the tool; and correspondingly means for making the transmission piston return, the method comprising:

influencing the shape of the stress wave by setting a clearance (d) between the energy transfer surface of the transmission piston and said energy receiving surface of the auxiliary piston before pressure fluid is allowed to push the transmission piston towards the tool so that when the clearance (d) is at its smallest, the energy transfer surface of the transmission piston is in contact with the energy receiving surface of the auxiliary piston formed to the tool or to a shank connected to the tool at the moment when the effect of the pressure fluid pressure begins, the stress wave being thus produced substantially by the effect of the pressing force produced by the pressure fluid pressure alone and transmitted to the tool by the transmission piston, the length of the stress wave being substantially equal to the effective time of the pressing force acting on the tool, whereas when the clearance (d) is at its longest, the stress wave is substantially produced by the impact of the transmission piston created as a result of a transmission piston motion caused by the pressure fluid pressure and acting on the energy receiving surface of the auxiliary piston formed to the tool or to a shank connected to the tool, the length of the stress wave being substantially twice the length of the transmission piston, and whereas when the clearance (d) is set to a value between the smallest and largest extent, the stress wave is produced by the combination of initial impact energy of the transmission piston acting on the energy receiving surface of the auxiliary piston formed to the tool or to a shank connected to the tool and transfer energy caused by the pressing force produced by the pressure fluid pressure alone transmitting to the tool by the transmission piston.

22. The method according to claim 21, wherein the percussion device further comprises a cylinder space provided in the body of the percussion device that contains the auxiliary piston formed to the tool or to a shank connected to the tool.

23. The method according to claim 22, wherein the step of setting a clearance includes allowing pressure fluid to be fed into the cylinder space provided in the body of the percussion device to push the auxiliary piston further or closer to the transmission piston.

24. A pressure fluid operated percussion device comprising:

means for feeding pressure fluid into and discharging the fluid from the percussion device;

means for producing a stress wave by means of the pressure fluid pressure to a tool connectable to the percussion device to move in a longitudinal direction in relation to the body thereof, the means for producing the stress wave comprising a working chamber in the body of the percussion device and a transmission piston provided in the working chamber to move in a longitudinal direction of the tool in relation to the body of the percussion device, the transmission piston having an energy transfer surface facing the tool to allow it to be brought into contact with an energy receiving surface of an auxiliary piston formed to the tool or to a shank connected to the tool;

means for making the pressure fluid pressure prevailing in the working chamber push the transmission piston towards the tool for compressing the tool in the longitudinal direction thereof by means of the pressure fluid pressure acting on the transmission piston so that a stress wave is produced in the tool; and correspondingly means for making the transmission piston return; and means for influencing the shape of the stress wave by setting a clearance (d) between the energy transfer surface of the transmission piston and said energy receiving surface of the auxiliary piston before pressure fluid is allowed to push the transmission piston towards the tool so that when the clearance (d) is at its smallest, the energy transfer surface of the transmission piston is in contact with the energy receiving surface of the auxiliary piston formed to the tool or to a shank connected to the tool at the moment when the effect of the pressure fluid pressure begins, the stress wave being thus produced substantially by the effect of the pressing force produced by the pressure fluid pressure alone and transmitted to the tool by the transmission piston, the length of the stress wave being substantially equal to the effective time of the pressing force acting on the tool, whereas when the clearance (d) is at its longest, the stress wave is substantially produced by the impact of the transmission piston created as a result of a transmission piston motion caused by the pressure fluid pressure and acting on the energy receiving surface of the auxiliary piston formed to the tool or to a shank connected to the tool, the length of the stress wave being substantially twice the length of the transmission piston, and whereas when the clearance (d) is set to a value between the smallest and largest extent, the stress wave is produced by the combination of initial impact energy of the transmission piston acting on the energy receiving surface of the auxiliary piston formed to the tool or to a shank connected to the tool and transfer energy caused by the pressing force produced by the pressure fluid pressure alone transmitting to the tool by the transmission piston.

25. The percussion device according to claim 24, wherein the percussion device further comprises a cylinder space provided in the body of the percussion device that contains the auxiliary piston formed to the tool or to a shank connected to the tool.

26. The percussion device according to claim 25, wherein the means of influencing the shape of the stress wave further comprises a pressure fluid pump and channel connected to the cylinder space for providing pressure fluid to the cylinder space provided in the body of the percussion device to push the auxiliary piston further or closer to the transmission piston.

* * * * *